US005897033A

United States Patent [19]

Okawa et al.

[11] Patent Number: 5,897,033

[45] Date of Patent: Apr. 27, 1999

[54] CONTAINER HAVING SLIT VALVE

[75] Inventors: Hiroyuki Okawa; Hiroshi Mizushima; Tetsuhiro Osawa; Shinichi Inaba, all of Tokyo, Japan

[73] Assignees: Yoshino Kogyosho Co., Ltd.; Kao Corporation, both of Tokyo, Japan

[21] Appl. No.: 09/102,274

[22] Filed: Jun. 22, 1998

[30] Foreign Application Priority Data

Jun. 20, 1997 [JP] Japan ..... 9-164473

[51] Int. Cl.[6] ..... B67D 37/00

[52] U.S. Cl. ..... 222/212; 222/490; 222/494; 222/546

[58] Field of Search ..... 222/212, 490, 222/494, 501, 545, 546, 556

[56] References Cited

U.S. PATENT DOCUMENTS

| | | | |
|---|---|---|---|
| 4,749,108 | 6/1988 | Dornsbusch et al. | 222/212 |
| 5,271,531 | 12/1993 | Rohr et al. | 222/490 X |
| 5,390,805 | 2/1995 | Bilani et al. | 222/490 X |
| 5,632,420 | 5/1997 | Lohrman et al. | 222/494 X |
| 5,743,443 | 4/1998 | Hins | 222/490 |
| 5,769,253 | 6/1998 | Gross | 222/556 X |
| 5,788,108 | 8/1998 | Rohr | 222/556 X |

*Primary Examiner*—Kevin P. Shaver

*Attorney, Agent, or Firm*—Oblon, Spivak, McClelland, Maier & Neustadt, P.C.

[57] ABSTRACT

A container has a valve (2) and a lid (3) which covers the valve (2) from the outside. The valve (3) includes a slit (23) which opens due to outward deformation of the valve (3) when the internal pressure of the body (1) is higher than atmospheric pressure, and which closes due to elasticity of the valve (3) when the internal pressure is approximately equal to atmospheric pressure. The container of the present invention further comprises a pushing structure (4) formed on the inside of the lid (3), this pushing structure (4) being shaped so as to come into contact with the valve (2) when the lid (3) is shut, thereby pushing the valve (2) slightly inwards to open the slit (23).

8 Claims, 3 Drawing Sheets

CONTAINER HAVING SLIT VALVE

BACKGROUND OF THE INVENTION

The present invention claims priority from Japanese Patent Application No. 9-164473 filed Jun. 20, 1997, which is incorporated herein by reference.

1. Field of the Invention

The present invention relates to a container for liquids or powders which comprises an elastically deformable body and a valve provided in an opening of the body, and which is so constituted that small quantities of the contents held within the body can be discharged at a time from the valve by means of pressure applied to the body from the outside.

2. Description of Related Art

There are known containers having a valve in an opening in a container body holding the contents in liquid form. If the opening is turned to face downwards and the body is compressed by being manually squeezed, this valve is pushed open and a small quantity of the contents is discharged. If the force exerted by the hand is relaxed, the valve is pushed back by atmospheric pressure and thereby closes the opening. Once the valve has been pushed back by air pressure, if the opening is turned to face upwards and manual pressure is removed from the container, the valve is again opened by being pushed inwards by atmospheric pressure, whereupon air flows into the body and the shape of the body, having, been deformed by being squeezed, returns to its original shape. Such a container is also provided with a lid or cap on the outside of the valve, and is designed so that shutting this lid protects the valve with its delicate structure and stops air from flowing into or out of the container, thereby preventing its contents from deteriorating, with the result that they can be stored for a longer time. The container disclosed in Japanese Published Patent Application No. 6-59900 (hereinafter termed the prior art publication) is an example of this sort of container.

The inventors responsible for the present application have previously designed a container for liquid cleaning agents of relatively high viscosity. A container with the kind of valve described above is extremely convenient in that it enables a liquid cleaning agent to be dispensed in small quantities corresponding to the amount required, and in that the discharge of cleaning agent can be stopped by relaxing the manual force squeezing the container body. However, repeated tests brought to light the following shortcoming. Namely, the elastic synthetic resin which forms the valve adheres to itself at the slit of the valve, so that when the container is next used, the slit of the valve no longer opens and closes smoothly.

SUMMARY OF THE INVENTION

The present invention has been devised in the light of this state of affairs. It is an object of this invention to provide a container wherein the valve can be opened and closed smoothly by means of changes in the pressure applied to the container body.

Namely, it is a further object of this invention to provide a container which is an improvement of a container having an elastically deformable body, a valve having a slit or slits opening due to outward deformation of the valve when the internal pressure of the body is higher than atmospheric pressure, and closing due to elasticity of the valve when the internal pressure disappears, and a lid for covering the valve from the outside, wherein the elastic synthetic resin forming the valve does not adhere to itself at the slit of the valve and the opening and closing of the valve is not impeded.

According to the invention, a pushing structure comes into contact with the valve when the lid is shut, whereby the slit of the valve is maintained slightly pushed open.

According to the invention, a container has a body, a valve has a slit which opens due to outward deformation of the valve when the internal pressure of the body is higher than atmospheric pressure and closes due to elasticity of the valve when the internal pressure is approximately equal to atmospheric pressure, and a lid which covers the valve from the outside. The container has a pushing structure which is shaped so as to come into contact with the valve when the lid is shut, thereby pushing the valve slightly inwards to open the slit. The pushing structure is preferably protrusively formed on the inside of the lid.

With a container according to this invention, when the container ha been left unused for a long time, then if the lid has been shut, the pushing structure pushes the valve backwards and inwards whereby instead of the slit of the valve being fully closed, it is maintained in a slightly open state. Because the slit of the valve is kept slightly open, adhesion of the slit of the valve after long-term storage can be prevented.

The aforementioned prior art publication discloses is a structure wherein a valve is provided in an opening of an elastically deformable body, the valve deforming in accordance with the pressure inside and outside the container body and thereby presenting either a convex or concave shape relative to the outside, and this valve is covered from the outside by a lid. Nevertheless, the technical idea of pushing open the valve when the lid is shut does not exist in the aforementioned prior art publication. The descriptions given in the prior art publication with reference to FIG. 2 or FIG. 11 thereof are descriptions to the effect that when the lid has been shut, the valve comes up against a projection on the inside of the lid which prevents further movement of the valve, so that even if the internal pressure of the container body increases, the slit of the valve cannot open.

According, to the present invention, preferably, the head of the pushing structure has a spherical surface. This is because a spherical surface is the most suitable structure for gently pushing open the slit of the valve inwards. The protruding structure formed on the back of the lid according to the prior art publication has a different purpose, and its shape is therefore also significantly different.

The valve of the present invention preferably comprises a cylindrical supporting portion and a disc-shaped movable portion linked directly to this supporting portion, these portions having been integrally molded from an elastic synthetic resin material. Furthermore, preferably, when the internal pressure is approximately equal to atmospheric pressure, the disc-shaped movable portion forms a partial spherical surface protruding inwards into the opening, and the radius of curvature of this partial spherical surface is set so as to be slightly larger than the radius of curvature of the hemispherical surface formed on the inside of the lid.

The valve of this invention preferably has a cross-shaped slit formed at the apex of the inwardly protruding partial spherical surface. This is a suitable structure for a valve which is gently pushed open inwards when the lid is shut. A silicone rubber is suitable for the elastic synthetic resin material used for the valve according to this invention.

Furthermore, a structure according to the present invention is preferably constituted as follows. Namely, the lid is formed from a rigid plastic material, a first rib is formed around the periphery of the protruding structure on the inside of this lid, a second rib is formed around the periphery of the valve so as to oppose and come into contact with the first rib, whereby when the lid is shut, these two ribs stop any flow into or out of the opening regardless of whether the valve is open or closed. This is because in the present invention, since the slit of the valve is in a slightly opened state when the lid has been shut and covers the valve, it is desirable to have a structure whereby the opening is tightly scaled by the lid. Although a rib can be seen on the reverse side of the lid in the drawings of the prior art publication, this rib serves to prevent the valve from protruding outwards from the opening, and is different from a structure which tightly seals a periphery regardless of whether a valve is open or closed.

According to the present invention, the protruding structure provided on the inside of the lid can have a double structure comprising two spherical surfaces with different radii of curvature. The shape of the head of this protruding structure is not restricted to a spherical surface, and the present invention can be implemented in various configurations, using an ellipsoid of revolution, a paraboloid of revolution, etc.

BRIEF DESCRIPTION OF THE DRAWINGS

The present invention will be described in detail with reference to the accompanying drawings, in which.

DETAILED DESCRIPTION OF PREFERRED EMBODIMENTS

Figure 1:
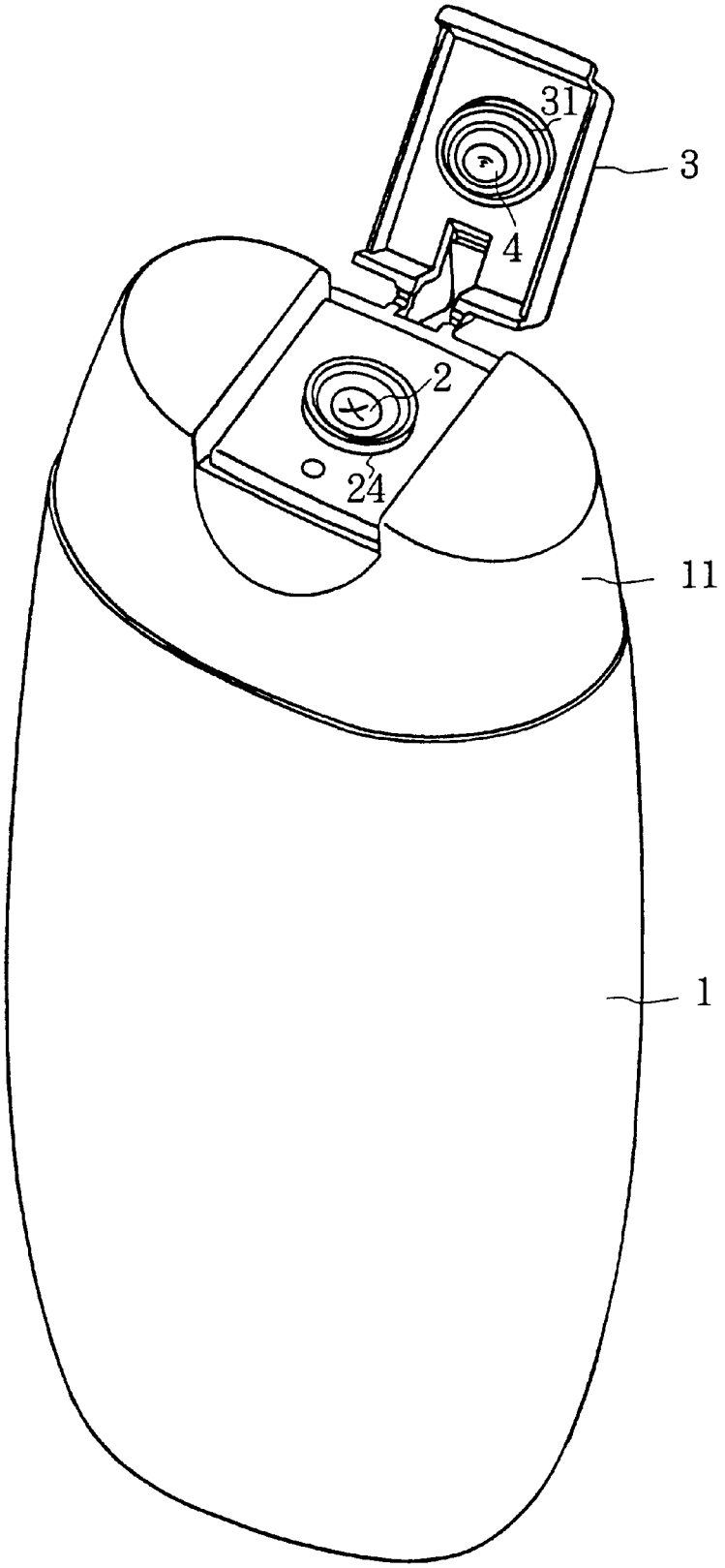
FIG. 1 is a perspective view of an entire container according to an embodiment of the present invention.
Figures 2A, 2B:
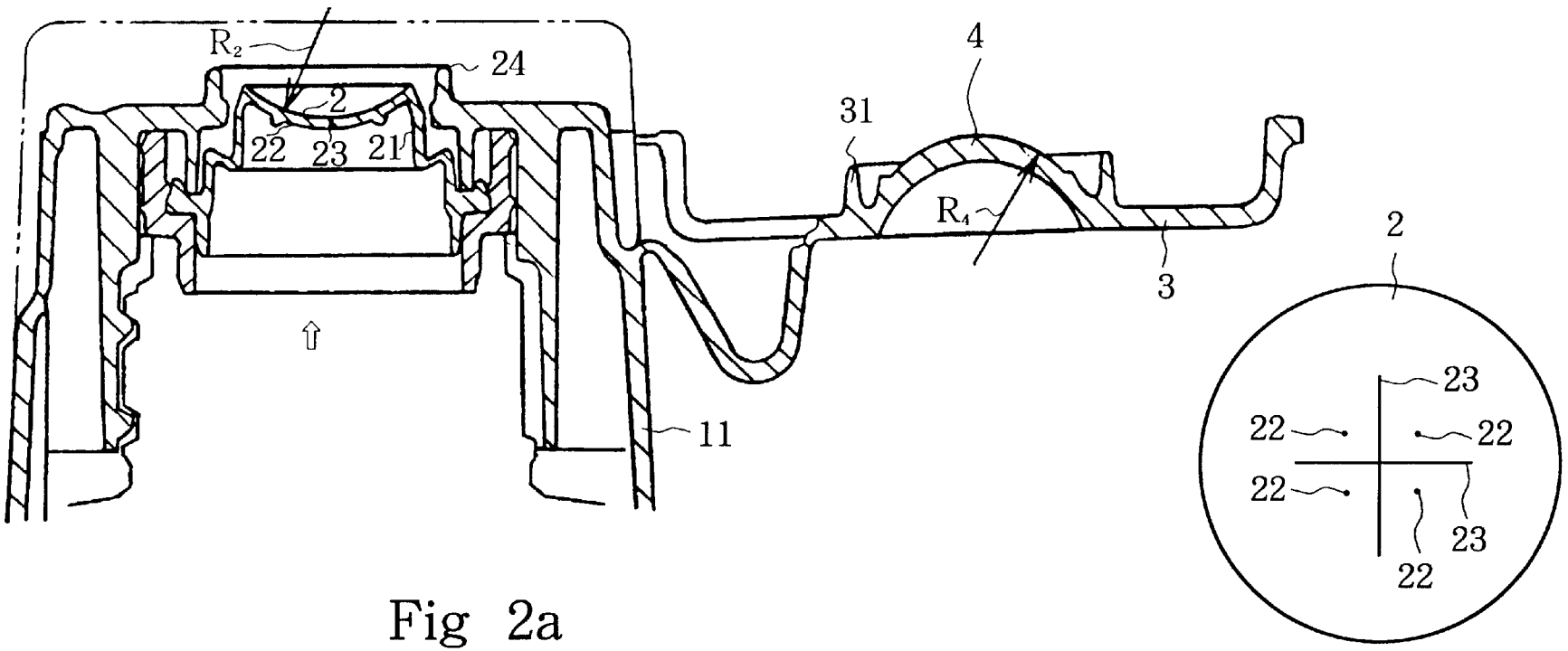
FIG. 2*a* is a cross-sectional view of the opening portion of a container according to a first embodiment of this invention (with the lid open)
FIG. 2*b* is a plan view of the valve shown in FIG. 2*a;*

As shown in FIG. 1, a container according to this embodiment is a structure has an elastically deformable body 1 which holds a high viscosity cleaning agent (e.g., shampoo); valve 2 provided in an opening at the top of this body 1 by way of cap 11; and a lid 3 which covers this opening from the outside of valve 2. As shown in FIG. 2*a*, this valve 2 is integrally molded from an elastic synthetic resin material, and more precisely from a silicone rubber. It comprises a cylindrical supporting portion 21 and disc-shaped movable portion 22 molded directly to this supporting portion 21, wherein a cross-shaped slit 23 is formed in the center of movable portion 22.

When the internal pressure of body 1 is equal to atmospheric pressure, slit 23 is closed. If the internal pressure of container body 1 becomes higher than atmospheric pressure, this valve 2 opens outwards. Conversely, if the internal pressure of container body 1 becomes lower than atmospheric pressure, valve 2 opens inwards and allows air to enter container body 1. Namely, if body 1 is held with the opening turned to face downwards and is compressed by being manually squeezed, the internal pressure in the body 1 increases and a small quantity of the contents are discharged from valve 2. When a certain amount has been discharged, valve 2 closes and the discharge of contents stops. Moreover, if the opening is turned to face upwards and the hand is removed from the container, the internal pressure of body 1 becomes lower than atmospheric pressure, with the result that valve 2 opens inwards and air is introduced into the body 1.

A protruding structure 4 is formed on the inside of lid 3. This protruding structure 4 is so shaped that it comes into contact with valve 2 when lid 3 is shut, and pushes valve 2 slightly inwards to open slit 23. FIG. 2*a* is a vertical section of the opening portion, and shows the situation in which lid 3 is open. Lid 3 is a rigid plastic molding and can freely open and shut relative to the container body opening fitted with valve 2. As shown in FIG. 2*a*, protruding structure 4 is formed on the inside of lid 3, and this protruding structure 4 has a spherical surface.

In greater detail, as shown in FIG. 2*a*, when the internal pressure is approximately equal to atmospheric pressure, its own elasticity results in the disc-shaped movable portion of valve 2 forming a spherical surface which protrudes inwards into the opening. Letting the radius of curvature of this spherical surface be $R_2$ and the radius of curvature of the spherical surface formed on the inside of lid 3 be $R_4$, these values are set so that:

$$R_2 > R_4.$$

Figure 3A:
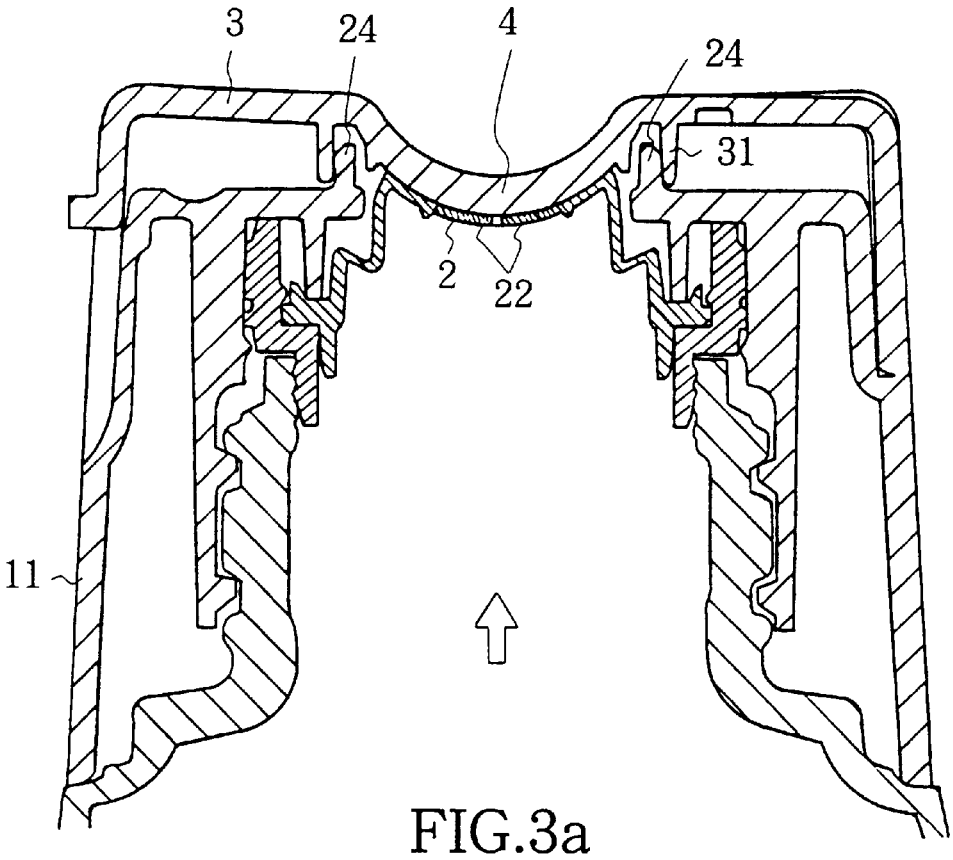
FIG. 3*a* is a cross-sectional view of the opening portion of a container according to a first embodiment of this invention (with the lid shut)
Figure 3B:
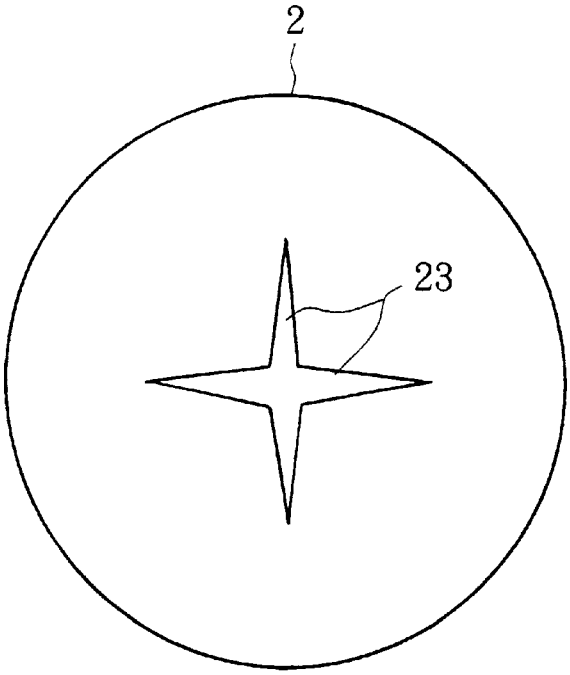
FIG. 3*b* is a plan view of the valve shown in FIG. 3*a.*

Valve 2 has cross-shaped slit 23 formed at the apex of the spherical surface which protrudes inwards in this way. Looking at this cross-shaped slit 23 in the direction of the directing arrow shown in FIG. 2*a*, then when lid 3 is open as shown in FIG. 2*a*, this slit 23 is closed into a cross as depicted in the enlarged view of FIG. 2*b*. If lid 3 is shut, protruding structure 4, which has a spherical surface, comes into contact with valve 2 and pushes elastic valve 2 slightly downwards, as shown in sectional view in FIG. 3*a*. In this situation, slit 23 of valve 2 as seen in the direction of the directing arrow shown in FIG. 3*a* is slightly open as shown in the enlarged view given in FIG. 3*b*. Thus, when slit 23 is open, there is little likelihood of adhesion of the silicone rubber at the two sides of slit 23 of movable portion 22.

Rib 31 is formed around the periphery of protruding structure 4 on the inside of lid 3. When lid 3 is shut, its rib 31 fits against rib 24 formed around the periphery of valve 2, thereby constituting a scaling structure which stops any flow into or out of the opening. This structure is provided because when lid 3 is shut, valve 2 is in a slightly open state and therefore valve 2 alone is insufficient to stop flow through the container opening. Accordingly, rib 24 and rib 31 serve to stop any flow into or out of the container opening. Furthermore, protruding structure 4 is made of a different material from the elastic synthetic resin of valve 2 and therefore, unlike the case where the same kind of material remains in contact for a long time, even if the container is left unused for a long period of time the two materials do not stick together and become hard to separate. In other words, there is no occurrence of adhesion.

The protruding structure provided on the inside of lid 3 may be a double structure. Namely, this protruding structure may comprise, on top of a protruding portion having a spherical surface with radius of curvature $R_4$, another protruding portion having a spherical surface with smaller radius of curvature $R_5$. By employing such a structure, when lid 3 is shut, its protruding structure 4 pushes down the central portion of valve 2 where slit 23 is formed. Consequently, instead of the whole of valve 2 being made to stretch, only its central portion in which slit 23 is located stretches. This reduces the likelihood of valve 2 deforming, when the container is left unused over a long period of time.

The action of the two ribs 24 and 31 will now be further described. When lid 3 is shut, rib 31 provided on the inside of lid 3 comes into contact with rib 24 provided around the periphery of valve 2. This contact isolates the inside of the container body from the outside and prevents any flow of gas or liquid between the two. Thus whether a container is left unused for a long time after some initial use, or is being transported prior to use, this arrangement prevents any discharge of contents from the container.

Each of ribs 31 and 24 may have a protruding portion formed around the rib circumference so that the two ribs will engage together near the top of the rib. Lid 3 can be kept securely shut by these convex portions engaging together.

As has been explained above, according to this invention, when the lid is shut the slit of the valve is pushed slightly downwards and is thereby in an open state. Accordingly, even if a container according to this invention is left for a long time, adhesion of the slit does not occur. It is therefore possible to eliminate failure of the valve to open and close in accordance with the pressure of the container body when the container is next used.

What is claimed is:

1. A container comprising:

a container body;

a valve mounted to the container body at an opening of the container body, said valve including a slit which opens by outward deformation of said valve when an internal pressure of said container body is higher than atmospheric pressure, and closes due to elasticity of said valve when the internal pressure is approximately equal to atmospheric pressure;

a lid which covers said valve from the outside; and a pushing structure which is shaped and positioned so as to come into contact with said valve when the lid is shut, thereby pushing the valve inwards to open said slit.

2. A container according to claim 1, wherein said pushing structure is formed on said lid.

3. A container according to claim 2, wherein said valve and said pushing structure both have spherical surfaces.

4. A container according to claim 3, wherein the spherical surface of the valve is concave and the spherical surface of the pushing structure is convex, and wherein a radius of curvature of the spherical surface of the valve is greater than a radius of curvature of the spherical surface of the pushing structure.

5. A container according to claim 4, further comprising a second, smaller radius of curvature of the spherical surface of the pushing structure.

6. A container according to claim 1, wherein said valve is formed of molded silicone rubber.

7. A container according to claim 2, further comprising ribs formed on said lid and around said valve to form a sealing structure which seals the opening of the container body when said slit is opened by said pushing structure.

8. A container comprising:

a container body;

a concave spherical valve mounted to the container body at an opening of the container body, said valve including a slit which opens by outward deformation of said valve when an internal pressure of said container body is higher than atmospheric pressure, and closes due to elasticity of said valve when the internal pressure is approximately equal to atmospheric pressure;

a lid which covers said valve from the outside;

a convex spherical pushing structure which is shaped and positioned so as to come into contact with said valve when the lid is shut, thereby pushing the valve inwards to open said slit; and ribs formed on said lid and around said valve to form a sealing structure which seals the opening of the container body when said slit is opened by said pushing structure.

* * * * *